US005094516A

United States Patent [19]

Hunter

[11] Patent Number: 5,094,516

[45] Date of Patent: Mar. 10, 1992

[54] STORAGE BIN

[75] Inventor: Kim R. Hunter, Kent, Wash.

[73] Assignee: Tempress Incorporated, Seattle, Wash.

[21] Appl. No.: 568,341

[22] Filed: Aug. 15, 1990

[51] Int. Cl.[5] ..... A47B 88/00

[52] U.S. Cl. ..... 312/319; 312/348

[58] Field of Search ..... 312/319, 330.1, 332, 312/333, 348, 348.1, 346, 347

[56] References Cited

U.S. PATENT DOCUMENTS

| | | | |
|---|---|---|---|
| 2,731,321 | 1/1956 | Thompson | 312/348 |
| 2,926,978 | 3/1960 | Mitchell | 312/330.1 X |
| 3,326,617 | 6/1967 | Leland | 312/348 |
| 3,738,728 | 6/1973 | Eckard | 312/330.1 |
| 3,822,924 | 7/1974 | Lust | 312/348 X |
| 3,980,363 | 9/1976 | Dean et al. | 312/348 X |
| 4,061,375 | 12/1977 | Mertes | 312/348 X |
| 4,121,878 | 10/1978 | Lokken | 312/348 X |
| 4,502,741 | 3/1985 | DeVries et al. | 312/348 X |
| 4,600,255 | 7/1986 | Dubarko | 312/348 X |

FOREIGN PATENT DOCUMENTS

| | | | |
|---|---|---|---|
| 2019668 | 11/1971 | Fed. Rep. of Germany | 312/348 |
| 2603753 | 8/1977 | Fed. Rep. of Germany | 312/348 |

OTHER PUBLICATIONS

"Foam-Filled Cushions for Sliding Trays", NASA Tech Briefs, Spring 1980.

*Primary Examiner*—Kenneth J. Dorner
*Assistant Examiner*—Brian K. Green
*Attorney, Agent, or Firm*—Christensen, O'Connor, Johnson & Kindness

[57] ABSTRACT

Storage bins including slidable trays and unitary sidewalls are described. The trays of the storage bin are designed to be retained in a retracted position when the cover to the storage bin is opened. In addition, the trays can be easily removed from and replaced within the storage bin. The unitary sidewalls of the storage bin are interchangeable and allow for simpler and more efficient assembly and manufacture.

12 Claims, 7 Drawing Sheets

STORAGE BIN

FIELD OF THE INVENTION

The present invention relates to bins that include sliding trays for storing articles out of sight, and more particularly to such bins that can be installed at locations on a boat that otherwise are not used for storage.

BACKGROUND OF THE INVENTION

Secure storage space on boats or other vehicles is often limited. Boat owners often permanently carry only gear that is needed on each outing. Unfortunately, even the storage space for these items is limited. For those boat owners who use their boats for fishing, this means tackle boxes and other containers carrying their fishing gear must be brought onto the boat for each excursion and then carried back off when the day is done. While on the water, these tackle boxes and other containers often clutter the deck of the boat, which makes it difficult to get around the boat.

One way to provide additional storage on boats has been to install storage bins in the walls, bulkheads, transoms, gunnels or decks of a boat. Although this principle is sound, one application the present applicants are aware of involves a storage bin that is composed of approximately 30 individual pieces. Storage bins that are made up of such a large number of pieces cannot be assembled simply and easily, but rather require an assembly that is labor intensive. In addition, these bins are provided with individual drawers that, once the cover to the bin is open, tend to unilaterally slide out of the bin into an extended position. This often leads to spilled contents or the user being struck by the sliding drawer.

There is a need for a storage bin for use on a boat or other vessel that can be installed at locations that otherwise are not used to store items. The bin should be capable of being assembled simply and quickly from a minimal number of parts. It is desirable to design the storage bins so that some of the parts are interchangeable, and thus, can be produced from a single mold. In addition, it is desirable to provide a bin wherein the individual drawers are biased in a retracted position so they do not unilaterally slide out of the bin when the cover to the bin is open.

BRIEF DESCRIPTION OF THE DRAWINGS

For a more detailed description of the invention as well as other objects and features thereof, reference is made to the following detailed description to be read in conjunction with the accompanying drawings, wherein.

SUMMARY OF THE INVENTION

The present invention is a storage bin that can be installed in a wall, bulkhead, transom, gunnel, or deck of a boat or other vessel. The storage bin is constructed from a number of parts that makes it simple and easy to assembly the bin and includes trays that are biased to be retained in a retracted position even when the cover to the storage bin is open. The storage bin is designed so that it can be mounted flush in any of the structures described above. This storage bin is preferably made from plastics that are resistant to deterioration by ultraviolet light, fresh and salt water and other outdoor conditions. The storage bin is designed so that the trays can be easily removed and replaced in the storage bin for cleaning or replacement. The storage bin also includes left and right sidewalls that are structurally identical so that these elements can be made from a single mold and used interchangeably on a storage bin formed in accordance with the present invention.

The storage bin formed in accordance with the present invention includes a slidable tray having a front edge, a rear edge, a left side, and a right side. The slidable tray is supported between two sidewalls that are mutually opposed to each other, one sidewall supporting the left side of the slidable tray and the other sidewall supporting the right side of the slidable tray. The two sidewalls are interchangeable. The tray, when supported between the two sidewalls is slidable between a retracted position and an extended position.

DETAIL DESCRIPTION OF THE INVENTION

Figure 1:
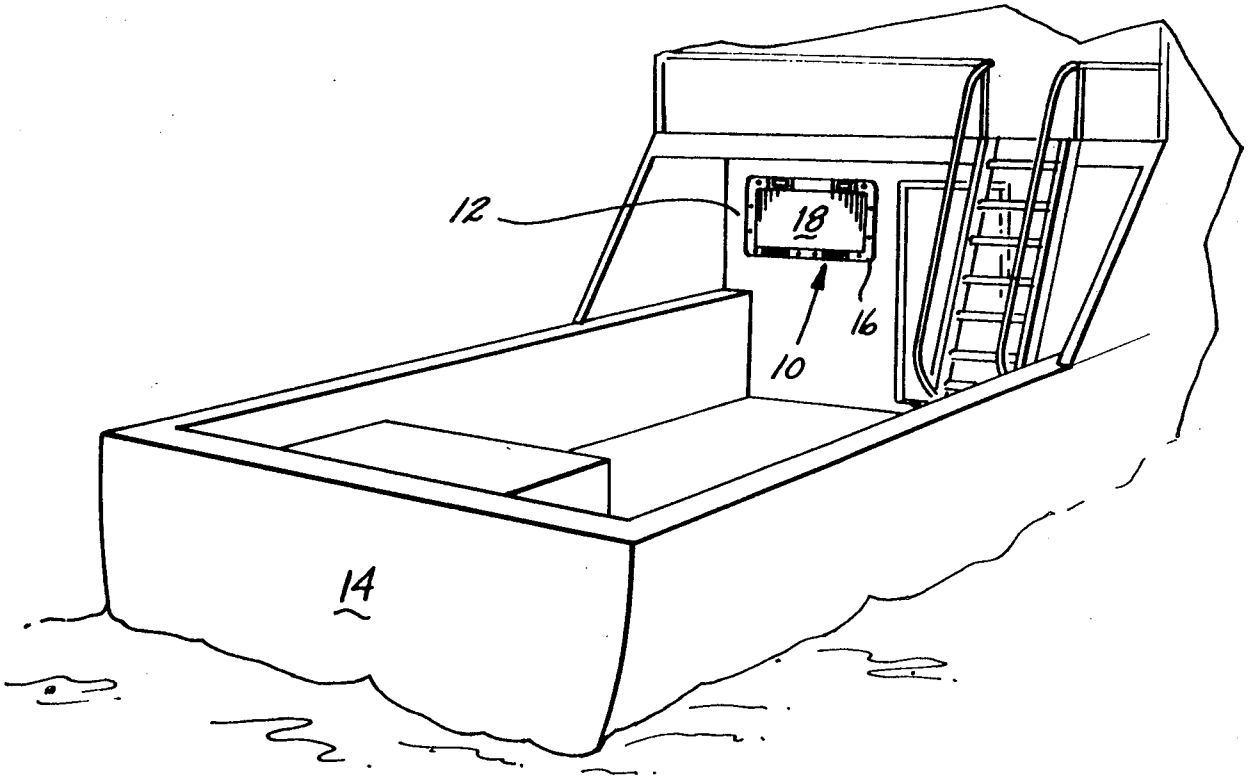
FIG. 1 is an environmental view of a storage bin formed in accordance with the present invention and installed in the bulkhead of a boat.

Referring to FIG. 1, a storage bin generally indicated by reference numeral 10 is mounted flush in bulkhead 12 of boat 14. Storage bin 10 is secured to bulkhead 12 by attaching hatch frame 16 to bulkhead 12 by conventional self-setting screws or the equivalent. Access to the inside of storage bin 10 is possible through hatch 18. Hatch 18 is hingedly attached to hatch frame 16 and can be securely fastened to hatch frame 16 to close storage bin 10.

Although storage bin 10 is illustrated as being mounted in bulkhead 12, it should be understood that storage bin 10 can also be mounted flush in a wall having a hollow space behind it, transom, gunnel, deck or any other location on boat 14 where a hollow space exists behind a flush surface strong enough to support storage bin 10.

Storage bin 10 is preferably made from plastic materials that are resistant to deterioration from ultraviolet light and fresh or salt water as well as other outdoor conditions. Preferably, storage bin 10 is made from an injection moldable thermoplastic material such as high density polyethylene.

Figure 2:
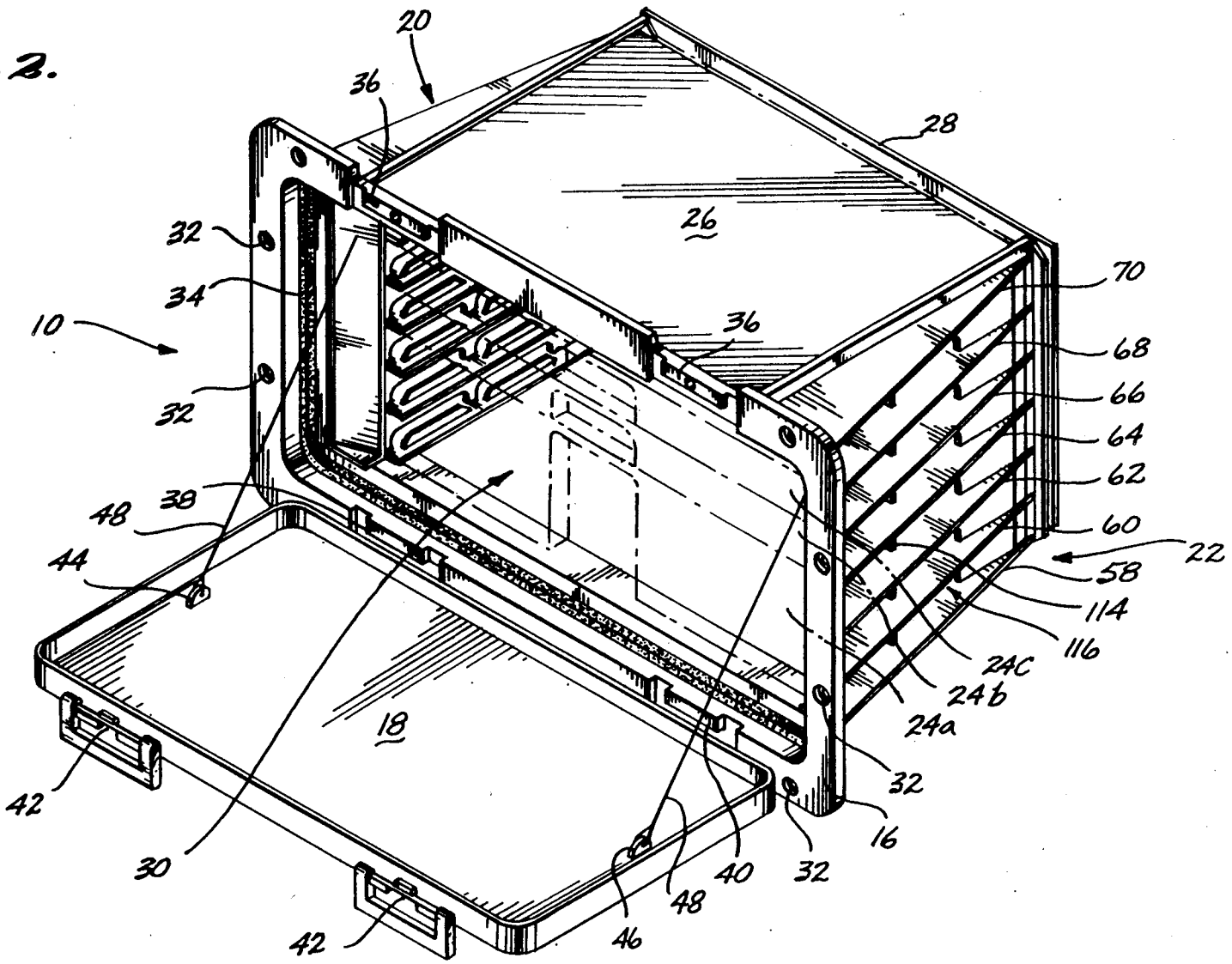
FIG. 2 is a perspective view of a storage bin formed in accordance with the present invention.

Referring to FIG. 2, storage bin 10 formed in accordance with the present invention includes hatch frame 16, hatch 18, left sidewall 20, right sidewall 22, and trays 24a–24c. Storage bin 10 also includes a means for retaining trays 24a–24c in a retracted position though this feature is not shown in FIG. 2. Storage bin 10 optionally includes flexible back 28 to keep trays 24a–24c from passing through the back of storage bin 10.

Hatch frame 16 of storage bin 10 is rectangular in shape, being wider than it is high. Hatch frame 16 is a substantially flat element that will be mounted flush on the surface into which storage bin 10 is inserted. The center 30 of hatch frame 16 is cut out to allow trays 24a–24c to slide out of storage bin 10 and through hatch frame 16. Around the periphery of hatch frame 16 are located a plurality of holes 32 for receiving mounting hardware, such as self-setting screws for attaching hatch frame 16 to the surface into which storage bin 10 is mounted. Running around the periphery of the cutout center portion 30 of hatch frame 16 is elastomeric seal 34 that provides a watertight seal between hatch frame 16 and hatch 18 when storage bin 10 is securely closed. Hatch frame 16 along its upper long edge includes two spaced-apart female latch members 36.

Hingedly attached to hatch frame 16 is hatch 18 that is rectangular in shape and fits snugly into the cutout center portion 30 of hatch frame 16. Hatch 18 is hingedly attached to the lowermost long edge of hatch frame 16 at hing 38 and hinge 40. The long edge of hatch 18 opposite the edge that is hingedly attached to hatch frame 16 includes two spaced apart male latch members 42 that cooperate with female latch members 36 to securely fasten hatch 18 to hatch frame 16.

The inside surface of hatch 18 located proximate the left and right sides include fastener 44 and fastener 46, each fastener securing one end of cables 48. The end of cables 48 opposite fastener 44 and fastener 46 is attached to the interior of storage bin 10. When storage bin 10 is mounted such that hatch 18, when closed, is in a non-horizontal position, the length of cables 48 can be adjusted so that hatch 18 can be held in an open horizontal position and act as a table for temporarily carrying light objects. For a more detailed description of hatch frame 16 and hatch 18, reference is made to U.S. Pat. No. 4,846,089 to Steven D. Cedergreen.

Storage bin 10 optionally includes a rectangular-shaped flexible lid 26 fitted in the top of storage bin 10 that helps to retain items within top tray 24c of storage bin 10. Flexible lid 26 is made from a lightweight flexible material that can include a honeycomb structure to reduce its weight and improve its strength.

In accordance with the present invention, left sidewall 20 and right sidewall 22 are unitary elements (i.e., single pieces) and are mirror images of each other. Accordingly, left sidewall 20 and right sidewall 22 can be produced from a single mold. In the following description, the term sidewall 50 refers to both left sidewall 20 and right sidewall 22 in FIG. 2 and the subsequent FIGURES.

Referring to FIGS. 3–8, sidewall 50 includes front edge 52, rear edge 54, inclined surface 56, a plurality of flanges 58, 60, 62, 64, 66, 68, and 70, groove 72 for flexible lid 26, plurality of tracks 74, 76, 78, 80, 82, 84, and 86, plurality of upper guides 88, plurality of lower guides 90, fasteners 92 for flexible back 28 and vertical male detent 94.

Figure 3:
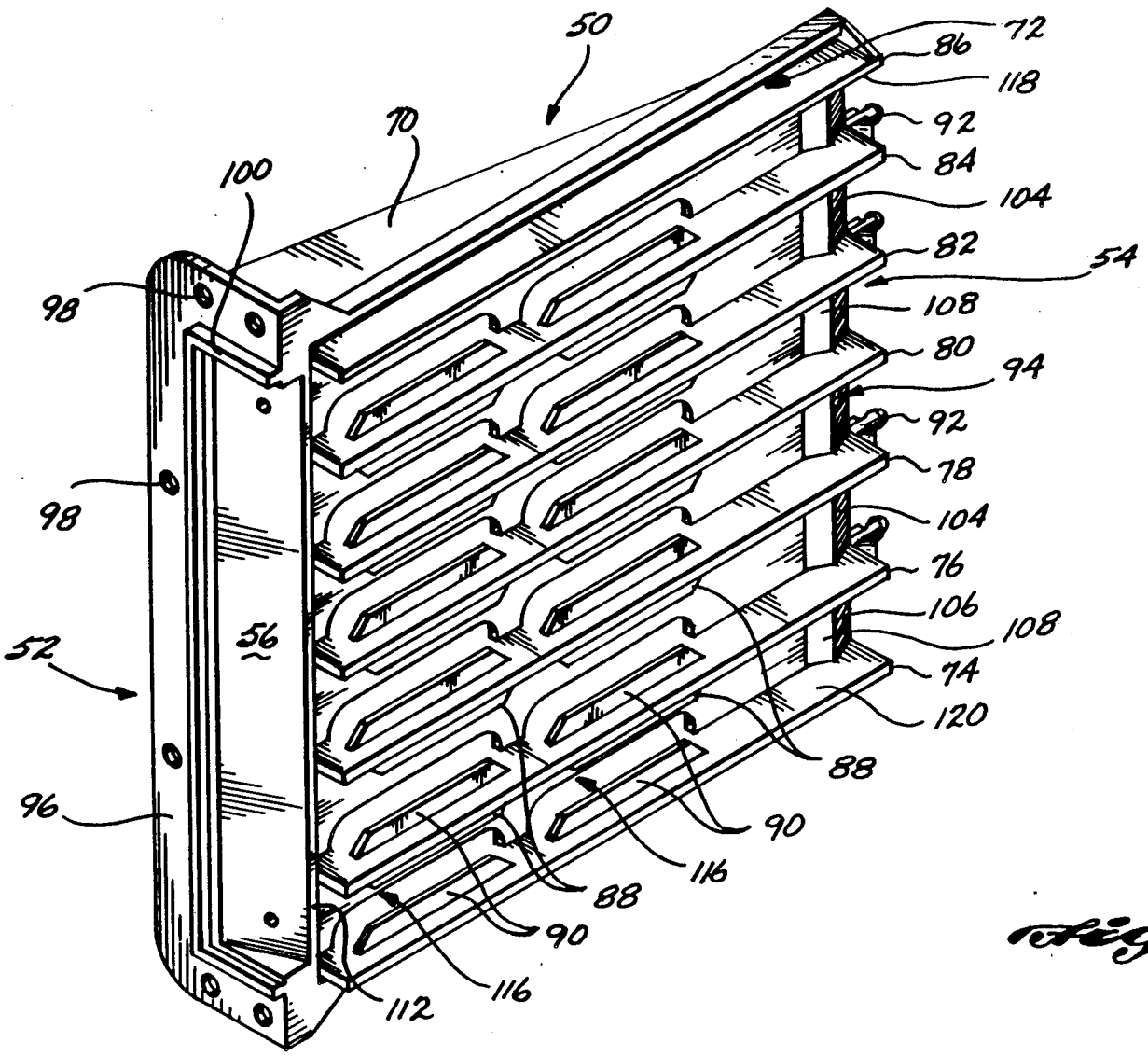
FIG. 3 is a perspective view of a sidewall of the storage bin shown in FIG. 2.
Figure 6:
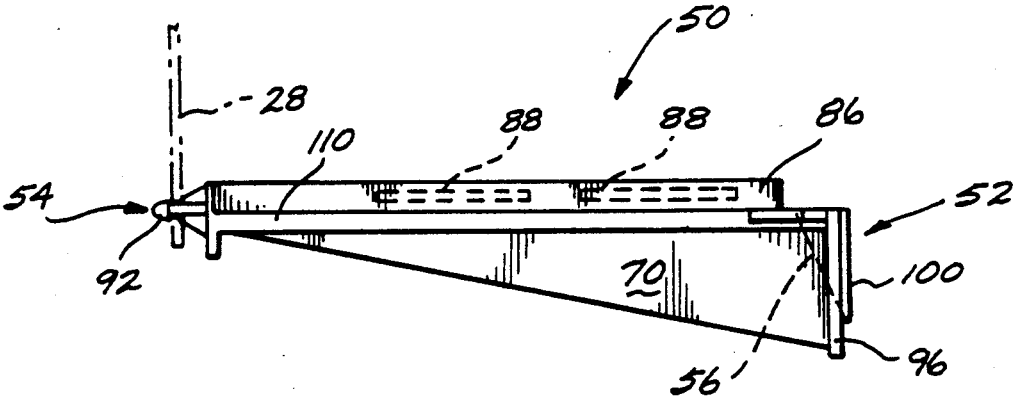
FIG. 6 is a plan view of the top of the sidewall shown in FIG. 3.
Figure 7:
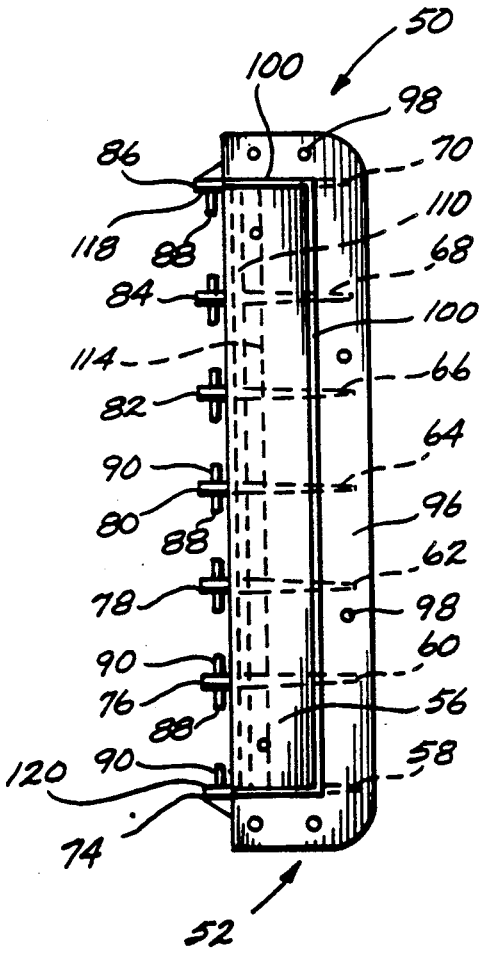
FIG. 7 is an elevational view of the front of a sidewall of the storage bin shown in FIG. 2.

Referring specifically to FIGS. 3, 6, and 7, front edge 52 of sidewall 50 includes a generally [-shaped member 96 having a flat surface lying in a vertical plane and dimensioned to be secured to the back side of hatch frame (16 not show) through rivet holes 98.

Running along the periphery of the inner edge of [-shaped member 96 is raised edge 100 that extends forward from the flat surface of [-shaped member 96. When sidewall 50 is attached along front edge 52 to the inside surface of the hatch frame, raised edge 100 fits just inside the rectangular center opening (30 not shown) in the hatch frame. Front edge 52 also includes an inclined surface 56 that slopes toward the back of sidewall 50 from raised edge 100. Inclined surface 56 extends between the upper and lower short ends of [-shaped element 96 and forms the remaining portion of front edge 52. Inclined surface 56 is vertically oriented and terminates along a longitudinal edge, that as described below in more detail, is flush with the front of trays 24a, 24b, and 24c when the trays are in a retracted position.

Referring specifically to FIGS. 3–6 and 8, rear edge 54 of sidewall 50 is vertically oriented and parallel to the vertical plane that [-shaped element 96 of front edge 52 lies in. Rear edge 54 is a flat surface. Rear edge 54 has a height substantially equal to the height of inclined surface 56 of front edge 52.

Extending transverse and rearward from rear edge 54 are fasteners 92. Fasteners 92 are pointed members that reversibly retain optional, flexible back 28 of storage bin 10.

Flexible back 28 is made from a lightweight flexible material similar to the material used for flexible top 26. Flexible back 28 can include a single rectangular piece or several rectangular pieces. Flexible back 28 is fastened to rear edge 54 of left sidewall 20 and right sidewall 22 and extends therebetween. Flexible back 28 prevents trays 24a–24c with storage bin 10 from passing rearward past a retracted position and falling out the back of storage bin 410. It should be understood that the position of fasteners 92 illustrated is only exemplary of the many different positions along rear edge 54 that the fasteners may be located.

Figure 5:
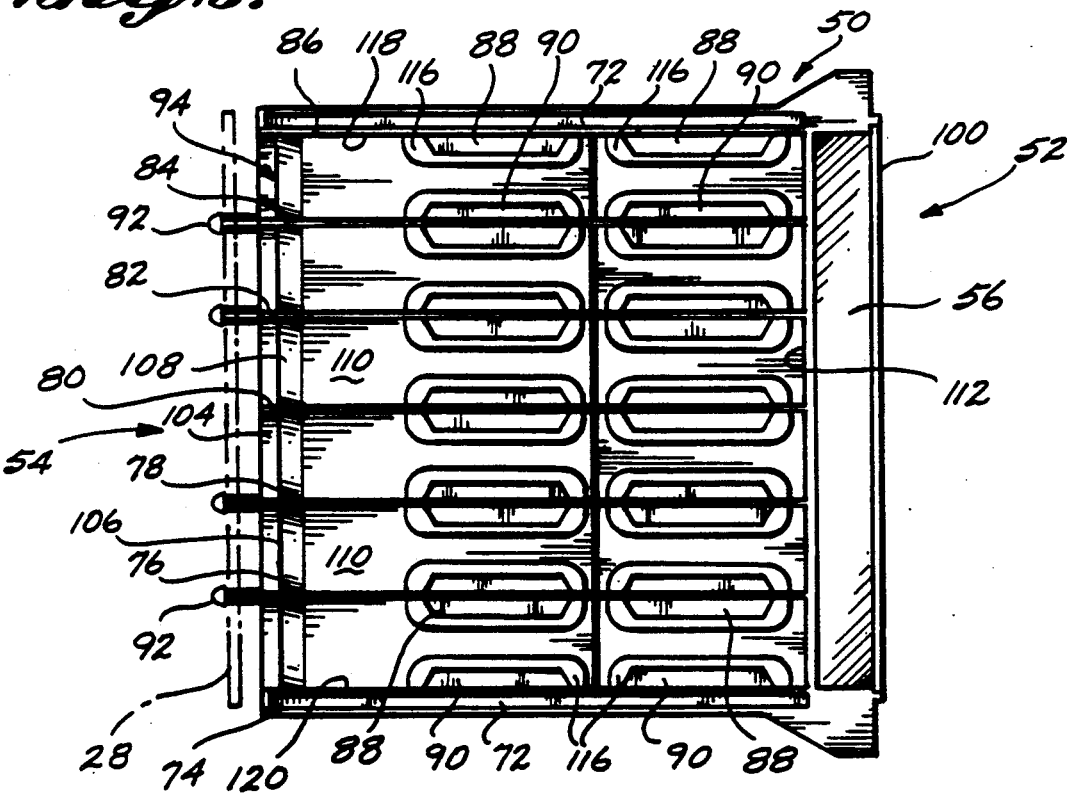
FIG. 5 is an elevational view of the opposite side of the sidewall shown in FIG. 4.

Referring to FIGS. 3 and 5, just forward of rear edge 54 of sidewall 50 is vertical male detent 94. Vertical male detent has a height substantially equal to the height of inclined surface 56 and rear edge 54. Vertical male detent 94 includes a rear raised portion 104 that is adjacent to rear edge 54. Rear raised portion 104 is inclined inward from rear edge 54 to apex 106. From apex 106 forward, male detent 94 includes a front raised portion 108 that is inclined outward from apex 106.

Figure 4:
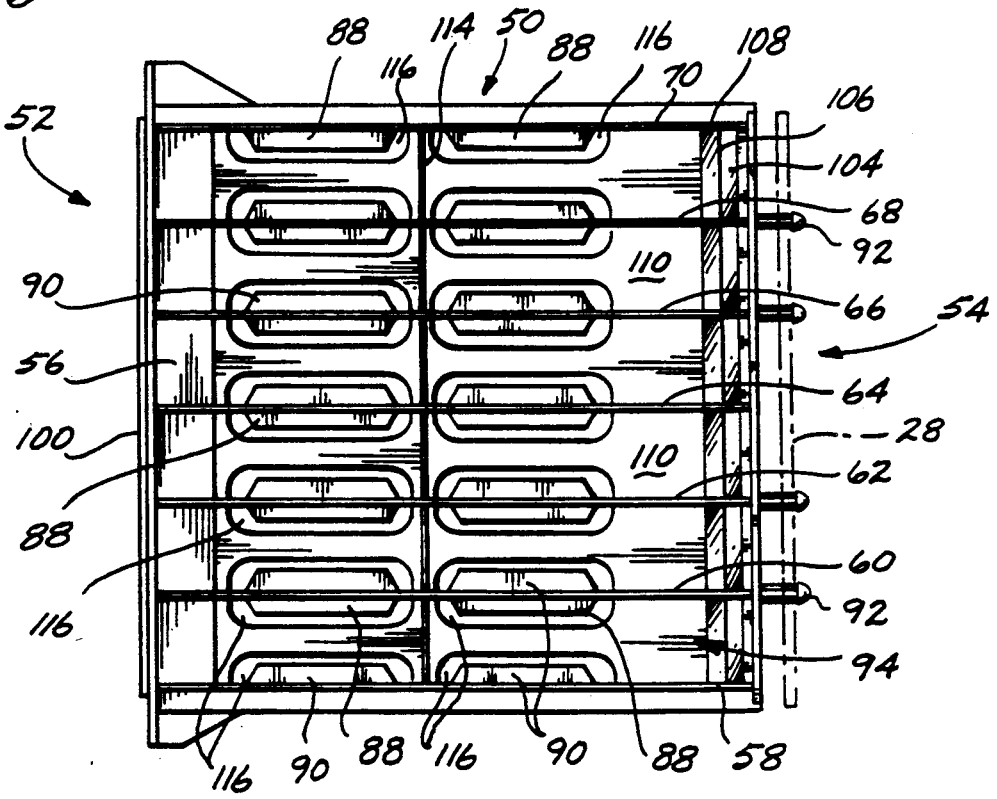
FIG. 4 is an elevational view of a side of the sidewall shown in FIG. 3.

Referring additionally to FIGS. 4 and 6, extending tranverse between front edge 52 including [-shaped element 96 and inclined surface 56 and the front edge of vertical male detent 94 is main rib 110 of sidewall 50. Main rib 110 makes up a substantial portion of sidewall 50 and lies in a vertical plane perpendicular to the vertical planes in which rear edge 54 and [-shaped member 96 lie. Main rib 110 extends from the rear of inclined surface 56 along an edge slightly to the outside of the inside end of inclined surface 56. The small portion of inclined surface 56 to the inside of the edge along which main rib 110 extends from the back of the inclined surface defines retaining edge 112.

Figure 8:
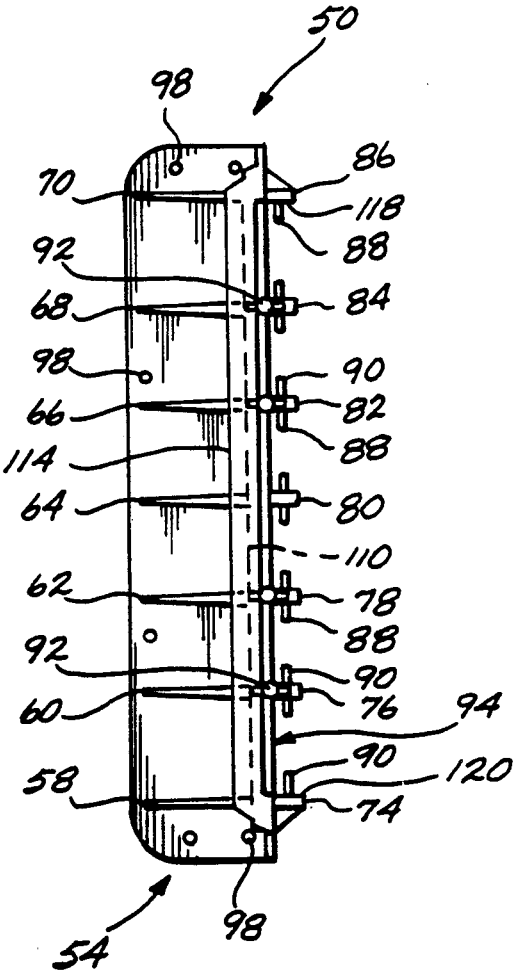
FIG. 8 is an elevational view of of the back of the sidewall shown in FIG. 7.

Referring additionally to FIGS. 7 and 8, sidewall 50 includes a plurality of flanges 58, 60, 62, 64, 66, 68, and 70 that extend outward tranverse from main rib 110. These flanges also extend between the rear of front edge 52 and the front of rear edge 54. As measured in a direction perpendicular and outward from main rib 110, the flanges increase in width from rear edge 54 moving along their length to the back of front edge 52.

Flanges 58, 60, 62, 64, 66, 68, and 70 are equally spaced apart. Although the equally spaced configuration shown is preferred, it should be understood that other configurations including larger or smaller spacings between adjacent flanges, uneven spacings between adjacent flanges or even a fewer or greater number of flanges would be within the scope of the present invention.

Referring specifically to FIG. 4, extending between the approximate longitudinal centers of seventh flange 70 and first flange 58 in a vertical direction and intersecting each of the intermediate flanges 60, 62, 64, 66, and 68 at approximately their longitudinal centers optional vertical rib 114.

To the left and right of vertical rib 114 in FIG. 4 are openings 116 passing through main rib 110 of sidewall 50. Openings 116 are cut out of main rib 110 and help to reduce the weight of sidewall 50 without reducing its strength. In addition, since sidewall 50 is preferably made by injection molding thermoplastic materials, openings 116 reduce the amount of thermoplastic material that is needed to mold sidewall 50.

Referring to FIGS. 3, 5, 6, 7, and 8 on the side of sidewall 50 opposite the side that carries the flanges and vertical rib 114, are a plurality of horizontally running tracks 74, 76, 78, 80, 82, 84, and 86. Each individual track lies in a horizontal plane in which a corresponding flange on the opposite side of main rib 110 lies. Each track extends inward from main rib 110 a distance that remains uniform along its length. Each track runs from retaining edge 112 to rear edge 54.

Seventh track 86, the uppermost track of sidewall 50 includes lower surface 118. Lower surface 118 carries two downward extending upper guides 88. Upper guides 88 are generally rectangular-shaped elements that extend downward from lower surface 118 a distance approximately equal to one-fifth of the distance between seventh track 86 and adjacent track 84. Upper guides 88 are positioned laterally on each side and centered laterally around vertical rib 114. Upper guides 88 are centered along the width of the tracks such that upper guides 88 are inside of main rib 110 and inside of the innermost edge of inclined surface 56.

First track 74, the lowermost track includes upper surface 120. Upper surface 120 carries two lower guides 90 that are identical to upper guides 88 described above with reference to seventh track 86; however, lower guides 90 extend upward from upper surface 120.

Intermediate tracks 76, 78, 80, 82, and 84 each include two upper guides 88 and two lower guides 90 positioned on each track as described hereinabove with respect to seventh track 86 and first track 74.

Referring primarily to FIG. 5, above seventh track 86 and below first track 74 is groove 72 for receiving the sides of optional flexible lid 26. Groove 72 helps to retain flexible lid 26 in position, yet allows flexible lid 26 to be removed therefrom when necessary. Groove 72 is provided above seventh track 86 and below first track 74 so sidewall 50 can be used for either left sidewall 20 or right sidewall 22 in FIG. 2.

Figure 9:
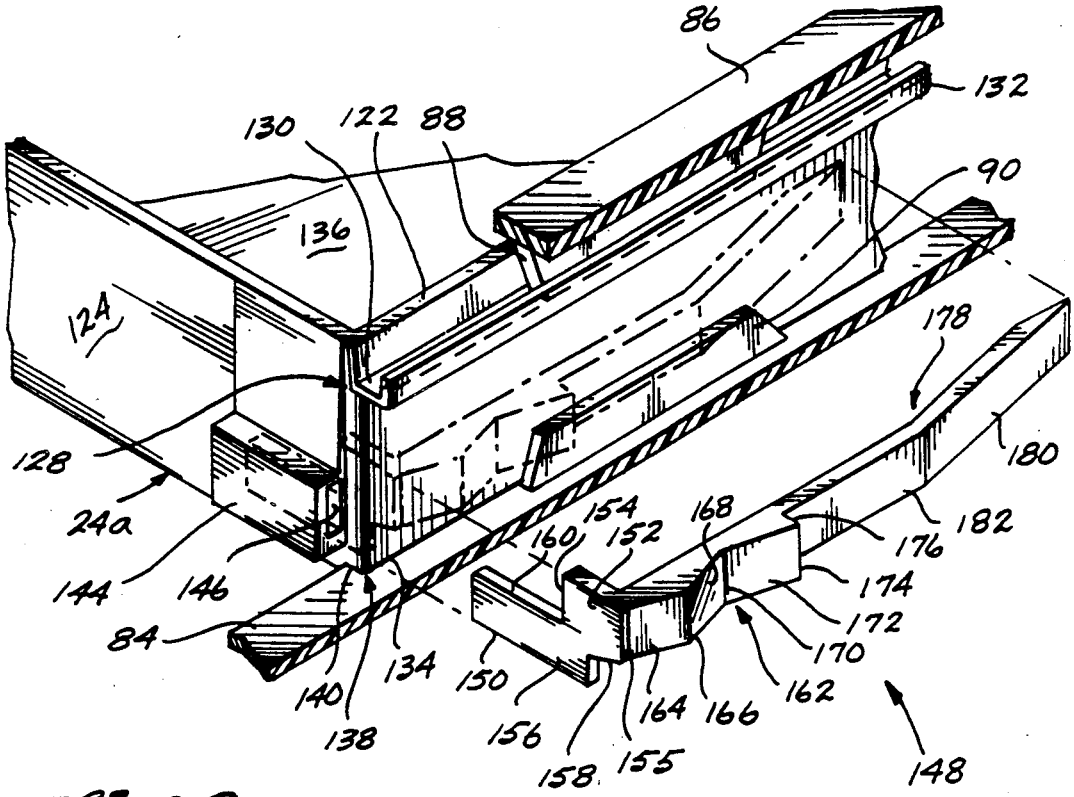
FIG. 9 is a perspective view of the rear corner of a tray for the storage bin shown in FIG. 2 with a portion of the sidewall cut away.
Figure 10:
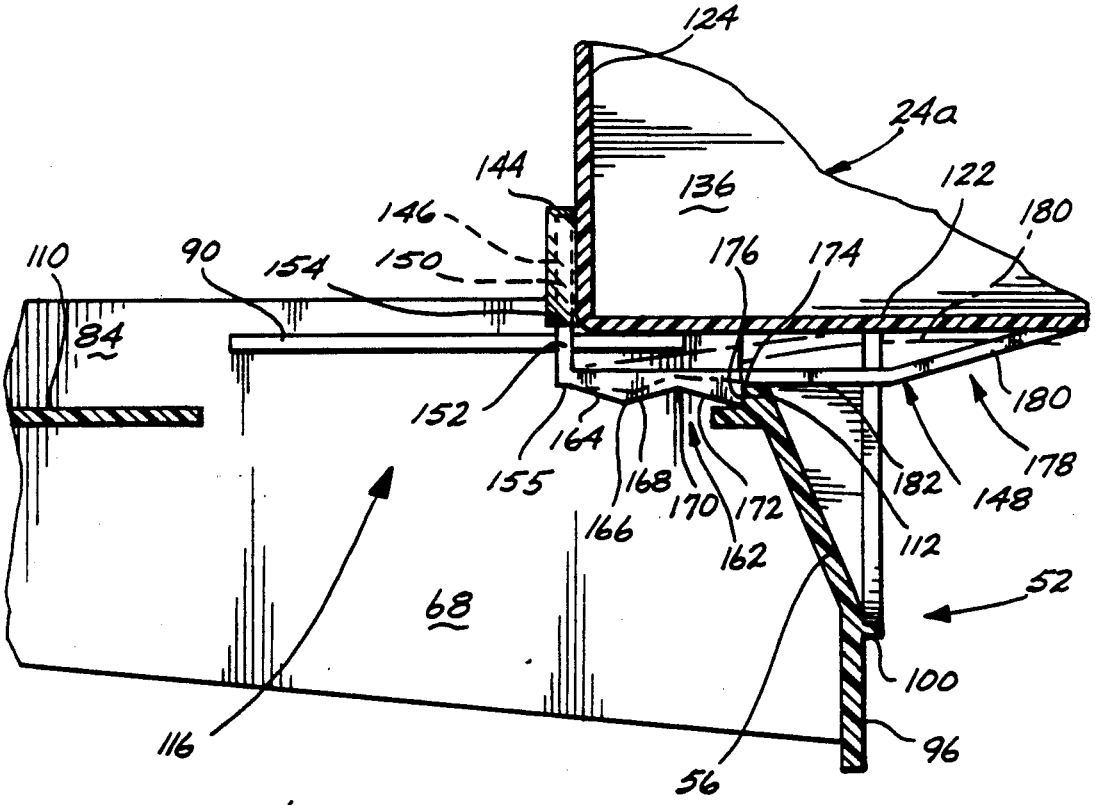
FIG. 10 is a plan view of a cross section through the front of the storage bin shown in FIG. 2 with a tray in an extended position.

Referring to FIGS. 2, 9, and 10, a storage bin formed in accordance with the present invention includes a plurality of trays **24*a*, 24*b*, and 24*c* that can be of equal height or different height. The height of trays 24*a*, 24*b*, and 24*c* is a multiple of the distance between two adjacent tracks of sidewall 50. Trays 24*a*, 24*b*, and 24*c* are generally rectangular members that are dimensioned to slide between upper and lower guides of opposing left sidewall 20 and right sidewall 22 and fit between rear edge 54 and retaining edge 112. Trays 24*a*, 24*b*, and 24*c*** each include front, rear, left and right walls and a bottom or floor.

Referring primarily to FIG. 9, right wall and left wall 122 of tray **24*a* are mirror images of each other so a description of the left wall 122 of tray 24*a* is also an accurate description of the right wall of tray 24*a*. The right and left designations with respect to FIGS. 9–12 refers to the right and left of the storage bin as viewed from the front end toward the rear end. Left wall 122 at top 126 includes grooved rack 128. Grooved track 128 extends outward from top 126 of left wall 122 and extends from rear wall 124 to the front wall (not shown) of tray 24*a*. Grooved track 128 includes bottom 130 that extends perpendicularly outward from left wall 122 along an edge below top edge 126 of left wall 122. The edge of bottom 130 opposite the edge that is attached to left wall 122 extends upward to form sidewall 132 that terminates at a location below top 126 of left wall 122. The shape and location of grooved member 128 is designed to receive upper guides 88 of seventh track 86 when tray 24*a*** is inserted into a storage bin formed in accordance with the present invention.

The bottom of left wall 122 terminates in a plane above bottom 136 of tray **24*a*. The bottom of left wall 122 is attached to bottom 136 of tray 24*a* by corner 138 in the shape of one step going from bottom 136 to the bottom of left wall 122. Accordingly, an indentation is formed at the edge where bottom 136 of tray 24*a* and the bottom of left wall 122 meet. Corner 138 includes a horizontal section 140 having one edge attached to the bottom of left wall 122 and opposite edge attached to one edge of a vertical section that connects horizontal section 140 to tray bottom 136. The edge of the vertical section opposite the edge attached to horizontal section 140 is attached to bottom 136 of tray 24*a*. Horizontal section 140 of corner 138 slides on the upper surface of sixth track 84 when tray 24*a* is inserted into storage bin 10**.

Rear wall 124 of tray **24*a* at its bottom, left-hand corner includes housing 144 that includes a horizontal slot 146. Horizontal slot 146 is dimensioned to snugly receive a portion of stay 148** described hereinbelow in more detail.

Still referring primarily to FIG. 9, a storage bin formed in accordance with the present invention includes stay 148 that helps to retain tray **24*a* in a retracted position. Though not shown, a second stay is provided on the right side or rear wall 124 of tray 24*a***.

Stay 148 is a generally L-shaped member that has its short end inserted into housing 144. The short end of stay 148 that is received in housing 144 includes a rectangular-shaped first tab 150 that has its length lying horizontally. Attached to the upper right-hand corner of rectangular-shaped tab 150 is substantially square elevated tab 152. Elevated tab 152 is attached to the right-hand upper corner of first tab 150 such that right vertical side 154 is to the right of the left side of first tab 150. Bottom side 158 of elevated tab 152 is below top side 160 of first tab 150.

Extending transverse forward from the upper half of left side 155 of square tab 152 is female detent element generally indicated by reference numeral 162. Female detent element 162 is an elongate member that includes rear inclined surface 164, apex 166, intermediate inclined surface 168, trough 170, and front inclined surface 172. Rear inclined surface 164 is adjacent the left-hand uppermost end 155 of elevated tab 152. When measured along a horizontal plane, rear inclined surface 164 increases in thickness along its length to apex 166 where rear inclined surface 164 terminates and intermediate inclined surface 168 begins. From apex 166, intermediate inclined surface 168, when measured along a horizontal plane, narrows in thickness down to a width substantially equal to the width of rear inclined surface 164 along edge 155 adjacent elevated tab 152. This end of intermediate inclined surface 168 defines trough 170 which also defines the beginning of front inclined surface 172. Front inclined surface 172 increases in thickness when measured along a horizontal plane until second apex 174. Female detent 162 then narrows abruptly back to its original width. This abrupt edge forms stop 174.

Extending forward from the edge defining stop 174, stay 148 includes an elongate biased member generally indicated by reference numeral 178 that on its end opposite the end attached to stop 174 includes biased tab 180. Portion 182 of elongate biased member 178, intermediate biased tab 180 and stop 174 is perpendicular to first tab 150 and elevated tab 152. Intermediate portion 182 extends from stop 174 a distance substantially equal to the length of female detent 162.

Biased tab 180 is also an elongate member and angles inward from the end of intermediate portion 182 of biased member 178 that is opposite stop 174. The end of biased tab 180 opposite the end that is attached to intermediate portion 182 narrows in width (measured horizontally) as it approaches its terminal end.

Still referring to FIG. 9, as shown in phantom lines, first tab 150 of stay 148 is received within slot 146 in housing 144. When tray **24*a* is positioned within the storage bin, elevated tab 152, female detent 162 and elongate biased member 178 are positioned above lower guide 90 and below upper guide 88. Upper guide 88 is positioned within groove 128. Bottom corner 138 of tray 24*a* slides on sixth track 84. The cooperation of these elements allows tray 24*a*** to slide smoothly from a retracted position to an extended position within a storage bin formed in accordance with the present invention.

Referring to FIG. 10, when tray **24*a* is slid into an extended position through the opening in the hatch frame, allowing access to its contents, stop 176 bears against retaining edge 112 on the inside of inclined surface 56. Retaining edge 112 bearing on stop 176 prevents tray 24*a* from sliding forward out of the storage bin. If the user purposefully wants to remove tray 24*a* from the storage bin, as shown in phantom lines, depressing elongate biased member 178 near intermediate portion 182 will cause stop 174 to be displaced from retaining edge 112. When stop 174 is displaced from retaining edge 112, tray 24*a*** can be slid forward out of the storage bin through the opening in the hatch frame.

Figure 11:
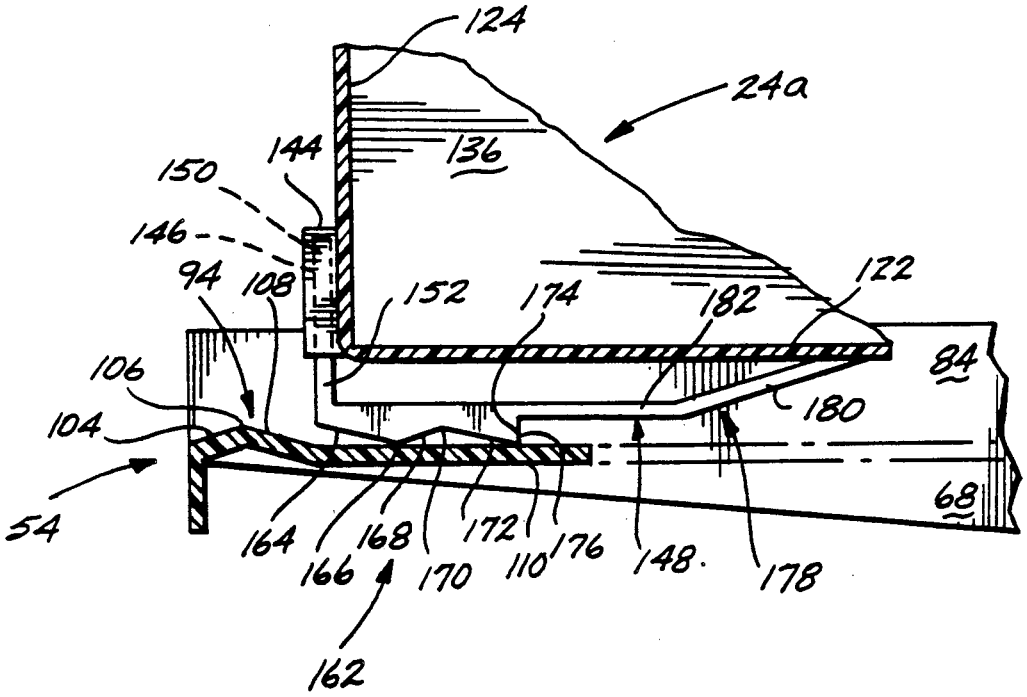
FIG. 11 is a plan view of a horizontal cross section of the rear of the storage bin shown in FIG. 2 with the tray approaching retracted position.
Figure 12:
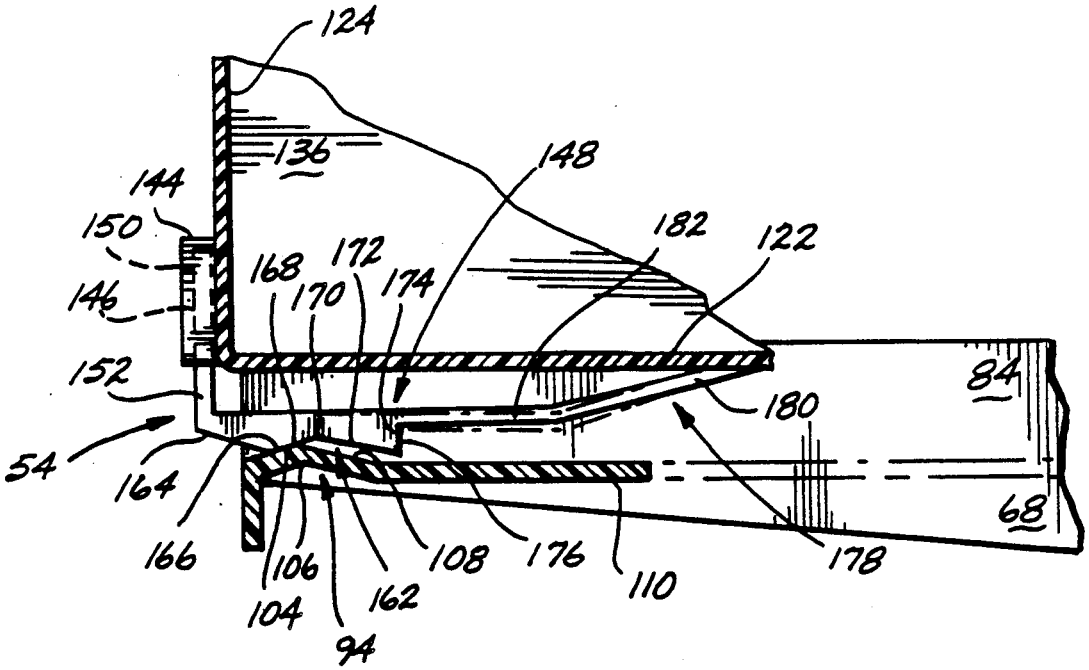
FIG. 12 is a plan view of the cross section shown in FIG. 11 with the tray in a retracted position.

Referring to FIGS. 11 and 12, when tray **24*a* is pushed rearward to a retracted position, first apex 166 of stay 148 slides along main rib 110 until first apex 166 reaches front raised portion 108 of male detent 94. When first apex 166 bears against front raised portion 108 of male detent 94, stay 148 is deflected inward. As tray 24*a* continues to be pushed rearward and first apex 166 continues to bear against front raised portion 108, stay 148 is continually deflected inward until first apex 166 clears apex 106 of male detent 94. As tray 24*a* continues rearward, first apex 166 of stay 148 begins to return to its original biased position as it slides down the length of rear raised portion 104. When trough 170 in stay 148 coincides with apex 106 of male detent 94, the cooperation between male detent 94 and female detent 162 serve to retain tray 24*a* in a retracted position. Tray 24*a* remains in the retracted position until enough force is exerted forward to cause apex 106 of male detent 94 to become dislodged from trough 170 in stay 148**.

A storage bin formed in accordance with the present invention includes approximately 10 pieces, not including mounting hardware and the cables used to secure the hatch. The sidewalls used in a storage bin formed in accordance with the present invention are single pieces that are interchangeable and can be produced from a single mold. The storage bin provides a means for retaining trays within the storage bin in a retracted position even when the hatch to the storage bin is open. In addition, the trays are also interchangeable and can be easily removed from the storage bin for cleaning and replacement.

While the present invention has been shown and described in the context of a preferred embodiment, in accordance with the present invention, it will be appreciated that many changes and modifications may be made therein without departing from the scope of the present invention as defined in the following claims.

The embodiments of the invention in which an exclusive property or privilege is claimed are defined as follows:

1. A bin for storing articles, the bin comprising:

(a) a slidable tray having a front, a rear, and left and right walls, the slidable tray having a biasing means attached thereto and extending along the left or right walls, the biasing means further including a stop means for limiting the forward extension of the slidable tray beyond an extended position;

(b) first and second sidewall means mutually opposed to each other, the first sidewall means including means for supporting a left side of the slidable tray and the second sidewall means including means for supporting a right side of the slidable tray, the first and second sidewall means are mirror images of one another which provides a means for the first and second sidewall means to be interchangeable with one another, the tray when supported between the first and second sidewall means being slidable between a retracted position and the extended position, the first and second sidewall means each include a front edge and a rear edge, the rear edge of each sidewall means including a raised means, at least one of the raised means cooperating with the biasing means to releasably retain the slidable tray in the retracted position, and the front edge of the first and second sidewall means includes a retaining edge means, at least one of the retaining edge means cooperating with the stop means, when the tray is in the extended position, for limiting the forward extension of the tray beyond the extended position; and (c) means joining said first and second sidewall means for holding the first and second sidewall means in a spaced relationship.

2. The bin of claim 1, wherein the first and second sidewall means are each one-piece elements.

3. The bin of claim 1, wherein the biasing means includes a detent mating with the raised means, such that when the detent and the raised means mate, the slidable tray is releasably retained in a retracted position.

4. The bin of claim 3, wherein the biasing means further comprises an elongate tab extending from one end of the detent, the elongate tab being substantially parallel to the detent.

5. The bin of claim 1, further comprising a flexible means extending between the rear edge of the first sidewall means and the rear edge of the second sidewall means, the flexible means being dimensioned to prevent the slidable tray from sliding past the retracted position.

6. The bin of claim 1, further comprising a hatch and a frame for the hatch, the front edge of the first and second sidewall means being attached to the frame.

7. The bin of claim 1, further comprising a flexible lid attached to the bin and extending between the first and second sidewall means in a plane above and parallel to the slidable tray.

8. A bin for storing articles, the bin comprising:

(a) a slidable tray having a front, a rear, and left and right walls, the slidable tray having a biasing means attached thereto and extending along the left or right wall, the biasing means further including a detent for limiting the forward extension of the slidable tray beyond an extended position, an elongate tab extending longitudinally from one of the detent, a second tab for securing the biasing means to the rear wall of the tray, the second tab extending transversely from the detent at an end opposite from the end from which the elongate tab extends;

(b) first and second sidewall means mutually opposed to each other, the first sidewall means including means for supporting a left side of the slidable tray and the second sidewall means including means for supporting a right side of the slidable tray, the first and second sidewall means are mirror images of one another which provides a means for the first and second sidewall means to be interchangeable with one another, the tray when supported between the first and second sidewall means being slidable between a retracted position and an extended position, the first and second sidewall means each include a front edge and a rear edge, the rear edge of each sidewall means including a raised means, at least one of the raised means mating with the detent to releasably retain the slidable tray in the retracted position, and the front edge of the sidewall means including a retaining edge means, at least one of the retaining edge means cooperating with the stop means, when the tray is in the extended position, for limiting the forward extension of the tray beyond the extended position; and (c) means joining said first and second sidewall means for holding the first and second sidewall means in a spaced relationship.

9. The bin of claim 8, wherein the first and second sidewall means are each one piece elements.

10. The bin of claim 8, further comprising a flexible means extending between the rear edge of the first sidewall means and the rear edge of the second sidewall means, the flexible means being dimensioned to prevent the slidable tray from sliding past the retracted position.

11. The bin of claim 8, further comprising a hatch and a frame for the hatch, the front edge of the first and second sidewall means being attached to the frame.

12. The bin of claim 8, further comprising a flexible lid attached to the bin and extending between the first and second sidewall means in a plane above and parallel to the slidable tray.

* * * * *

UNITED STATES PATENT AND TRADEMARK OFFICE

CERTIFICATE OF CORRECTION

PATENT NO. : 5,094,516

DATED : March 10, 1992

INVENTOR(S) : K.R. Hunter

It is certified that error appears in the above-identified patent and that said Letters Patent is hereby corrected as shown below:

| COLUMN | LINE | |
|---|---|---|
| 2 | 11 | after "approaching" insert --a-- |
| 2 | 45 | "Detail" should be --Detailed-- |
| 4 | 38 | "bin 410" should be --bin 10-- |
| 4 | 52 | "tranverse" should be --transverse-- |

Signed and Sealed this

Fourteenth Day of July, 1992

*Attest:*

DOUGLAS B. COMER

*Attesting Officer*

*Acting Commissioner of Patents and Trademarks*